US005854585A

United States Patent [19]

Kingma

[11] Patent Number: 5,854,585

[45] Date of Patent: Dec. 29, 1998

[54] MANUAL RESET ELECTRICAL EQUIPMENT PROTECTOR APPARATUS

[75] Inventor: Geoffrey Kingma, North York, Canada

[73] Assignee: Texas Instruments Incorporated, Dallas, Tex.

[21] Appl. No.: 27,174

[22] Filed: Feb. 20, 1998

Related U.S. Application Data

[60] Provisional application No. 60/043,991, Apr. 10, 1997.

[51] Int. Cl.[6] ..... H01H 37/54; H01H 37/00; H01H 37/06; H01H 37/14

[52] U.S. Cl. ..... 337/367; 337/348; 337/343; 337/362; 337/365

[58] Field of Search ..... 337/348, 343, 337/342, 333, 334, 298, 312, 314, 362, 365, 367, 372, 380

[56] References Cited

U.S. PATENT DOCUMENTS

| | | | |
|---|---|---|---|
| 3,099,732 | 7/1963 | Perry et al. . | |
| 3,258,567 | 6/1966 | Colavecchio | 337/342 |
| 3,288,967 | 11/1966 | Perry et al. . | |
| 3,622,930 | 11/1971 | D'Entremont . | |
| 3,832,667 | 8/1974 | Blanton | 337/354 |
| 3,840,834 | 10/1974 | Obenhaus et al. . | |
| 3,852,697 | 12/1974 | Snider | 337/348 |
| 3,924,213 | 12/1975 | Semple | 337/130 |
| 4,039,991 | 8/1977 | Bucheister | 337/348 |
| 4,053,859 | 10/1977 | Hollweck | 337/91 |
| 4,513,570 | 4/1985 | Yoshida et al. | 60/529 |
| 4,841,271 | 6/1989 | Purssell | 337/320 |
| 5,270,799 | 12/1993 | Rose | 337/354 |

*Primary Examiner*—Lynn D. Feild
*Assistant Examiner*—Anatoly Vortman
*Attorney, Agent, or Firm*—Russell E. Bauman; Richard L. Donaldson

[57] ABSTRACT

A manual reset electrical protector (10, 10') has a reset assembly (26, 26') having a guideway (28*a*, 28*a'*) and track (28*c*, 28*c'*) in which a slide member (30, 34, 34') is movable between a protracted position interrupting the movement of a movable electrical contact (22) mounted on a thermostatic disc (20) to preventg engagement of the movable contact with a stationary electrical contact (24) and a retracted position in which the movable contact is allowed to move unfettered into the contacts engagement position. A push button (32, 32') has a cam member (32*a*, 32*a'*) which, when the push button is depressed, rides against a follower (30*b*, 34*b*) attached to the slide member, causing the slide member to move to the retracted position against the bias of a spring (30*d*, 36). The movable contact (22) prevents movement of the slide member to the blocking, protracted position when in the contacts engaged position.

10 Claims, 3 Drawing Sheets

MANUAL RESET ELECTRICAL EQUIPMENT PROTECTOR APPARATUS

This application claims priority under 35 USC Section 119(e) (1) of provisional application number 60/043,991 filed Apr. 10, 1997.

BACKGROUND OF THE INVENTION

This invention relates generally to electrical equipment protective devices and more particularly to manually resettable protective devices for electrical equipment such as fractional horsepower motors which will de-energize the equipment upon the occurrence of over-temperature and/or over-current conditions.

Small protective devices comprising a housing containing an electric switch which includes a small current carrying thermostatic disc adapted upon the occurrence of certain thermal conditions to snap into and out of engagement with a stationary contact to respectively close and open an electric circuit are available which are very reliable and inexpensive. For applications in which the protectors are to be quickly responsive to very small current levels a supplemental heater is mounted within the device in heat transfer relation with the disc. An example of this type of protector is described and claimed in U.S. Pat. No. 3,622,930, the subject matter of which is incorporated herein by this reference. Such devices can be placed physically in close thermal coupling with the equipment to be protected and can be serially connected electrically to the equipment so that upon the occurrence of an over-temperature or an over-current condition the thermostatic disc will snap from the contacts engaged to the contacts disengaged position thereby de-energizing the equipment. When the temperature of the thermostatic disc falls below the calibrated reset temperature, the thermostatic disc will snap back to the contacts engaged position to re-energize the equipment. If the over-temperature and/or over-current condition is caused by a fault the equipment could cycle on and off indefinitely.

It is known to provide a manual reset function in a thermostatic switch to avoid such recycling. Known manual reset devices include a movably mounted electrically insulating member spring biased to move from a retracted position to a position overlying a stationary electrical contact upon movement of the thermostatic disc mounted movable electrical contact out of contact engagement with the stationary contact. When the thermostatic disc has cooled to its reset temperature the movable contact is prevented from making contact engagement with the stationary contact by the interposition of the insulating member. The insulating member is typically provided with a hand actuatable button, toggle or the like, to reposition the insulating member to a latched position away from the stationary electrical contact to permit contact engagement. Examples of switches having such a reset feature are shown in U.S. Pat. Nos. 3,099,732, 3,288,967 and 3,840,834. Although these devices are effective, it would be desirable to provide a thermostatic, manually resettable protective device which is less expensive, yet reliable in operation.

SUMMARY OF THE INVENTION

It is therefore, an object of the present invention to provide an improved, simple, inexpensive manual reset assembly particularly adapted for use with a current carrying bimetallic disc electrical equipment protector. Another object is a provision of a manual reset electrical equipment protector which is easily assembled. Since there are many applications in which an automatic reset protector is preferred, yet another object is the provision of a manual reset electrical equipment protector which utilizes a standard automatic reset protector in which minimal changes are required in the structure of the automatic reset protector so that both versions can be provided while minimizing parts inventory requirements. Yet another object of the invention is the provision of a manual reset assembly which avoids potential contamination of the contact mating surfaces of the electrical equipment protector with which it is used.

Briefly described, a manual reset electrical equipment protector made in accordance with the invention comprises a metallic can shaped first housing member having a wall member mounting a stationary electrical contact and a metallic lid-shaped second housing member attached to the first housing member with a layer of electrical insulation disposed therebetween, a current carrying thermostatic disc cantilever mounted on a heater which in turn is mounted on the second housing member and a movable electrical contact mounted on a free distal end of the disc adapted to move into and out of electrical engagement with the stationary electrical contact. A generally annular, electrically insulating third housing member is mounted on the wall of the first housing member in alignment with an aperture in the wall. The third housing member has a guideway which extends into the switch chamber of the first housing member. A slide member is movably mounted in the guideway and is provided with a spring member which biases the slide member toward the stationary electrical contact. A manual reset button is slidably received in the bore of the annular housing member and is provided with a cam depending therefrom which engages a follower surface provided on the slide member. Pushing the button inwardly causes the cam to force the follower and concomitantly the slide member, to move, against the bias of the spring, away from the stationary contact to a retracted position allowing the movable electrical contact to engage the stationary electrical contact, assuming the temperature of the disc is below its actuation or reset temperature. Movement of the slide member toward the stationary electrical contact is then limited by engagement of the slide member with the movable electrical contact. When an over-temperature condition occurs causing the temperature of the thermostatic disc to reach its actuation temperature the disc will snap to its contacts disengaged position and the slide member will move under the influence of the spring member to a protracted position in which movement of the movable electrical contact, after the disc temperature has reached the reset temperature, will be limited to a position spaced from the stationary electrical contact. According to a feature of the invention, the third housing member and the push button snap-fit together and the slide member snap fits into the guideway. The entire assembly then snap fits into the aperture made in the wall of the first housing member. According to a feature of one embodiment of the invention, the spring and cam member are formed of a unitary member attached to the slide member. In a second embodiment, the slide member has an integral follower surface and a separate spring member is operatively connected to the slide member.

BRIEF DESCRIPTION OF THE DRAWINGS

Other objects, advantages, and details of the novel and improved electrical circuit protector device of this invention appear in the following detailed description referring to the drawings in which.

DETAILED DESCRIPTION OF PREFERRED EMBODIMENTS

Figure 1:
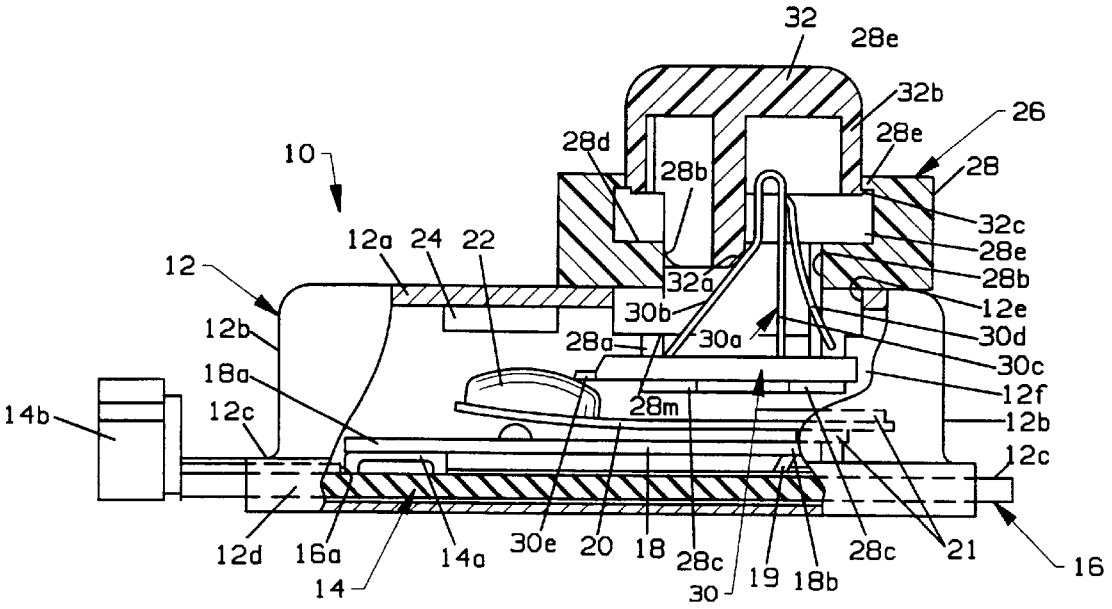
FIG. 1 is a front elevational view, partly in cross section, of a manual reset electrical equipment protector made in accordance with the invention shown in the open circuit, contacts disengaged position.
Figure 2:
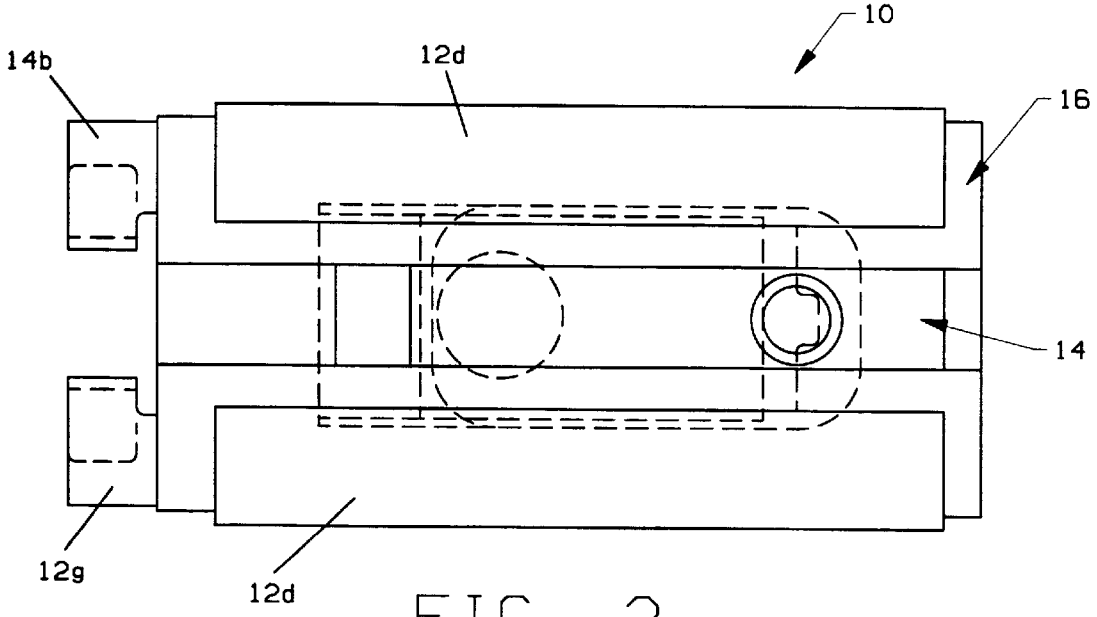
FIG. 2 is a bottom plan view of the FIG. 1 protector.
Figure 3:
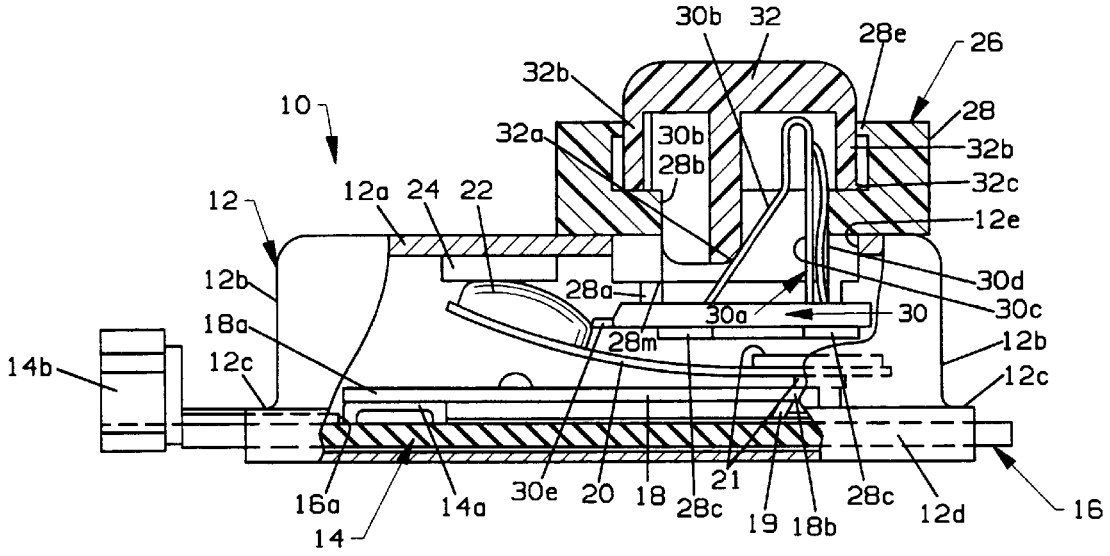
FIG. 3 is a view similar to FIG. 1 showing the protector in the closed circuit, contacts engaged position.

With reference to FIGS. 1–3, a manual reset electric equipment protector 10 made in accordance with the invention, comprises a first housing member 12 formed of suitable electrically conductive material configured generally as a can having an end wall 12*a* and sidewalls 12*b* depending therefrom, the sidewalls having a distal free end formed with an outwardly extending flange 12*c*. A second housing member 14, also formed of suitable electrically conductive material, configured as a lid, is attached to the open end of the first housing member with a strip 16 of suitable electrically insulative material interposed between the housing members. Two opposed flanges 12*d*, along with strip 16, are extended in length and bent over to clampingly engage the lid shaped housing member.

An elongated heater 18 has one end 18*a* welded to a detent portion 14*a* of housing member 14 received through cut-out portion 16*a* of strip 16. A snap acting thermostatic disc 20 is cantilever mounted in a conventional manner, as by welding thereto at an opposite end 18*b* of heater 18 through a weld slug 21. An electrically insulating spacer 19 is disposed between end 18*b* of the heater and second housing member 14. A movable electrical contact 22 is mounted on the free distal end 20*a* of disc 20 and is adapted to move into and out of electrical engagement with a stationary electrical contact 24 suitably attached, as by welding, to wall 12*a* of the first housing member. A terminal portion 14*b* extends from the second housing member 14 and a similar terminal portion 12*g* (see FIG. 1) extends from the first housing member 12.

Wall 12*a* is provided with an aperture 12*e* for reception of manual reset assembly 26 having a third housing member 28 formed of suitable material such as a moldable plastic, generally annular in configuration. Housing member 28 has a guideway portion 28*a* which is received through aperture 12*e* and is disposed in the switch cavity 12*f*. A slide member 30 is mounted for rectilinear motion on a track 28*c* between a retracted position shown in FIG. 3 and an extended or protracted position shown in FIG. 1. A combined generally W-shaped follower and spring member 30*a* has first and second legs 30*b*, 30*c* connected to slide member 30 and a third spring 30*d* extending from leg 30*c*, to be discussed below. Leg 30*b* extends at a selected angle from slide member 30 to serve as a follower surface. Member 30*a* is received through a bore 28*b* formed through housing member 28 with the follower surface of leg 30*b* cooperating with a cam 32*a* depending from a push button 32. Push button 32 is provided with a sleeve portion 32*b* having a lip 32*c* having an entrance taper and a radially extending flat exit stop surface allowing it to be snapped into bore 28*b* passing by a corresponding lip 28*e* having a facing entrance taper in one direction and a facing exit stop surface in the opposite direction. Once received in bore 28*b*, button member 32 is movable between an upper position wherein engagement of the non-tapered or stop surfaces of lips 28*e*, 32*c* limit outward movement and inward movement is limited by sleeve 32*b* engaging platform 28*d* formed in third housing member 28.

Thermostatic disc 20 is calibrated so that at ambient temperature conditions it assumes an upwardly concave configuration with movable electrical contact 22 in electrical contact engagement with stationary electrical contact 24, assuming that slide member 30 does not impede movement of the movable contact, as shown in FIG. 3. In the FIG. 3 condition, the toe 30*e* of slide member 30 is biased against movable electrical contact 22 by means of spring leg member 30*d* reacting against housing member 28 in bore 28*b*. Upon the occurrence of a fault condition or the like causing the temperature of thermostatic disc 20 to rise to its actuation temperature the disc will snap to its oppositely dished, upwardly convex configuration (not shown) in which movable contact 22 moves out of engagement with the stationary contact 24. At the same time, slide member 30 will move to its protracted position with toe 30*e* disposed in the path that movable contact 22 will take upon moving in the contacts engagement direction. Thus, when thermostatic disc 20 has cooled to its reset temperature it will attempt to snap back to its upwardly concave configuration; however, movement of the movable contact will be interrupted and limited by slide member 30, as shown in FIG. 1. Actual engagement of contact 22 by toe 30*e* will be at a location of contact 22 removed from the contact mating surfaces, as can be seen in comparing FIGS. 1 and 3, thereby avoiding any possibility of contaminating the mating surfaces by such engagement. As seen in FIG. 3, the actual contact engaging surface portion of movable contact 22 is outbound or beyond the center of the contact while toe 30*e* is adapted to engage the movable contact inboard of its center. The position of button 32 with lips 28*e* and 32*c* in engagement serve to limit travel of the slide member in the protracted direction with the edge of surface 28*m* of the guideway serving as an over-travel stop adapted to engage follower 30*b* in the event that dimensional variations in parts due to tolerances, permits such over-travel.

When it is desired to re-energize the circuit connected to selected electrical equipment, such as a fractional horsepower motor, after disc 20 has cooled to its reset temperature, push button 32 is depressed causing cam 32*a* to move downwardly forcing slide member 30 to move to the retracted position against the bias of spring member 30*d*. It will be understood that if the disc has not cooled to its reset temperature depression of push button 32 will have no affect on resetting of the protector since the disc will remain in the contacts disengaged configuration.

Figure 4:
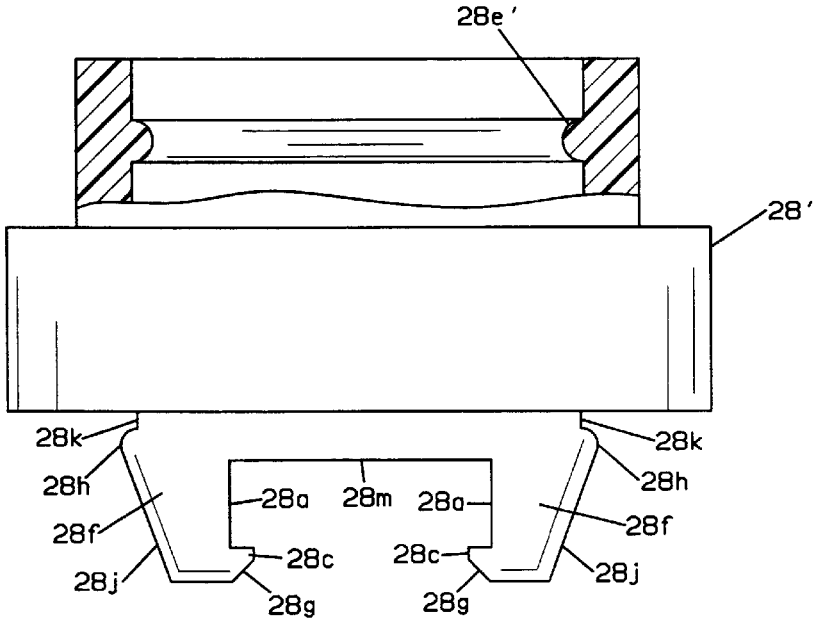
FIG. 4 is a side elevational view, partly in cross section, of a modified third housing member useful in the FIGS. 1–3 protector.

Third housing member 28 is configured so that slide member 30 can be snapped into guideway 28*a* and then housing member 28 can in turn be snapped into aperture 12*e* of housing member 12. These snap-in features are illustrated in FIG. 4 where opposed guideway legs 28*f* are formed with inner tapered surface 28*g* so that slide 30 can be pushed into the guideway utilizing the inherent flexibility of the plastic to cam the legs apart sufficiently for the slide to be received. Opposed outer surface portions 28*h* of legs 28*f* are spaced apart slightly more than the diameter of aperture 12*e* of housing 12. In conjunction with tapered outer surfaces 28*j* of legs 28*f* and cut-out portion 28*k* spaced apart slightly less than the diameter of aperture 12*e*, the housing can be snapped into aperture 12*e* of housing 12 due to the flexible nature of the plastic material. The upper portion of the third housing member shown in FIG. 4 has been modified moving lip 28*e*' from the entrance of bore 28*b*. Lip 28*e*' has a generally, in semi-circular configuration, in cross section, with tapered surface of button lip 32*c* allowing entrance into the bore but flat, radially extending surface of the lip preventing removal of the button from the bore.

Among the advantages provided by the invention is the ability to use a standard, calibrated, automatically resettable protector and by merely forming an aperture in the closed end wall of the housing, the device can be changed into a manual reset device by snapping in the reset assembly without any significant affect on the calibration of the device. This minimizes inventory requirements by utilizing parts from the automatically resettable protector.

Figure 5:
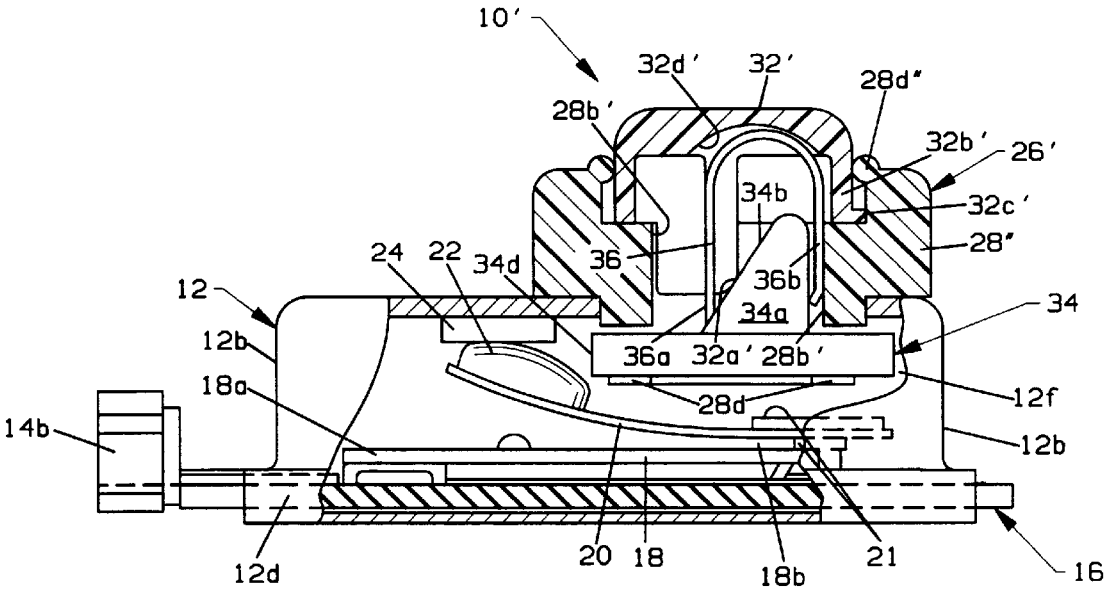
FIG. 5 is a view similar to FIG. 3 showing a second embodiment of the invention.
Figure 6:
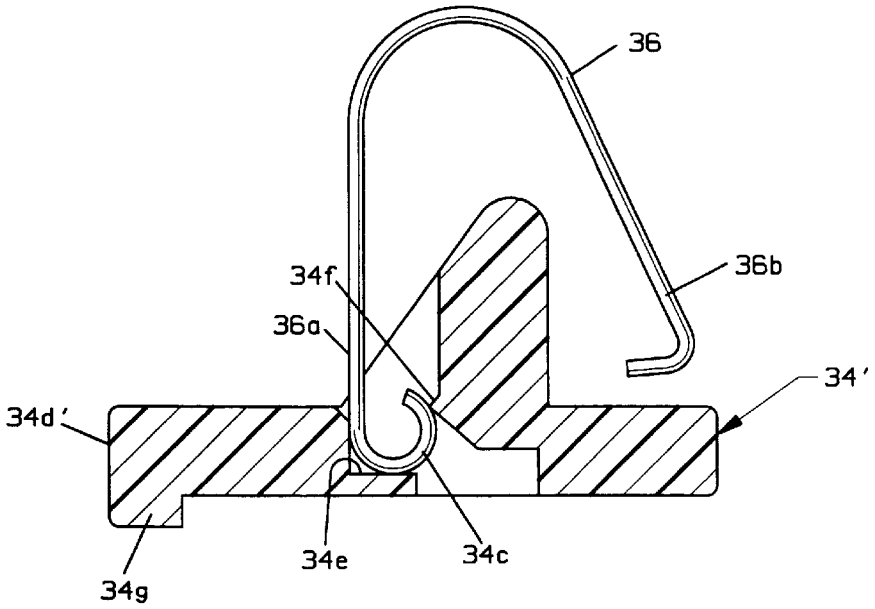
FIG. 6 is a modified slide/spring assembly useful in the FIG. 5 embodiment.

A second embodiment of the invention is shown in FIG. 5. Manual reset protector 10' comprises a reset assembly 26' having an annular third housing member 28" similar to housing member 28, 28' but adapted to accommodate a modified slide member 34 formed of suitable plastic material such as nylon molded to include follower 34*a* having a follower surface 34*b*. Slide member 34 is received on track 28*c*' for rectilinear movement between retracted (shown in FIG. 5) and protracted (not shown) positions under the influence of a discrete, generally U-shaped spring member 36 having first and second legs joined at a bight and an end of one leg 36*a* attached to slide member 34 and having the second leg 36*b* positioned to react against housing member 28" within bore 28*b*'. Slide member 34 is provided with a recessed spring seat 34*e* shown in FIG. 6, which cooperates with an opposing projection 34*f* to permit end 36*c* of spring 36 to be snapped into the seat. End 36*c* is formed into a partial circular configuration to permit relative rotation in the seat while being retained therein by projection 34*f*. Slide member 34 of FIG. 5 and 34' of FIG. 6 are provided with the same spring seat; however, slide member 34' is shown modified to include a toe portion 34*g* in cases where an increased vertical dimension of surface 34*d*' is desired. Spring member 36 is received within bore 28*b*' and extends into a recess 32*d*' in push button 32'. Annular housing member 28" is provided with a flexible bead 28*d*" at the entrance of bore 28*b*' which allows the tapered lip 32*c*' to pass by when the push button is originally inserted into bore 28*b*' but will inhibit removal of the push button due to the non-tapered, upper stop surface of lip 32*c*'.

As in the FIGS. 1, 2 embodiment, movable contact 22 will limit movement of the slide member by engaging end 34*d* of the slide member when the contacts are engaged; however, once the contacts move out of engagement, the slide member will be interposed into the path of movement of movable contact 22 thereby preventing re-engagement of the contacts until push button 32' has been depressed causing slide member 34 to move to the retracted position.

Although movement of slide member 34 in the protracted direction will be limited in the same manner as in the FIGS. 1–3 embodiment, the extended path of movement of slide member 34, as seen in FIG. 5, is positioned so that in the event of over-travel the slide member will be blocked by the edge of stationary contact 24 preventing engagement of the slide member with the mating surfaces of the contacts thereby avoiding any possible contamination of these surfaces. Further, in the design of switches utilizing current carrying thermostatic switches the contact making and breaking arc is directed away from the disc and in the structural arrangement according to the present invention the slide member is generally aligned with the disc, away from major affects of such arcs. As a result, less expensive plastic material, such as nylon can be employed for the slide member.

In view of the above, it will be seen that the various objects of the invention have been met. Various additional changes and modifications of the above described invention will be readily apparent to those skilled in the art and it is the intention that any such change or modification be deemed to come within the scope of the present invention as set forth in the appended claims.

What is claimed:

1. A manual reset circuit protector comprising:

a first housing member defining a switch cavity and having a wall mounting thereon a stationary electrical contact, the wall having a reset housing aperture formed therethrough, a second housing member attached to the first housing member, the second housing member mounting thereon a movable contact assembly, the movable contact assembly comprising a snap acting, cantilever mounted thermostatic disc, the disc having a free distal end, a movable electrical contact mounted on the free distal end adapted to move into and out of engagement with the stationary electrical contact, respective electrical terminals electrically connected to the stationary and movable electrical contacts, a manual reset assembly comprising a third housing member attached to the wall of the first housing member in alignment with the reset housing aperture, the third housing member having an opening formed therethrough in communication with the reset housing aperture, a slide member mounted on the third housing member within the switch cavity for rectilinear movement toward and away from the stationary electrical contact, the slide member having a follower surface extending into the opening in the third housing member, a push button disposed in the opening in the third housing member and movable in a direction in and out of the opening, the push button having a cam surface receivable on the follower surface and spring means for biasing the slide member toward the stationary electrical contact, the slide member being movable between a first retracted position away from the movable stationary contact when the push button is depressed into the opening by means of the cam member co-acting with the follower surface to push the slide member against the bias of the spring and a second protracted position adjacent the stationary electrical contact and in alignment with the movable electrical contact when the snap acting disc can snap to an open contact position allowing the slide to move in response to the bias of the spring, the slide member when in the protracted position limiting movement of the movable electrical contact when the disc attempts to snap back to the contacts engage position.

2. A manual reset circuit protector according to claim 1 in which the movable contact assembly includes a heater element.

3. A manual reset circuit protector comprising:

a first cup shaped electrically conductive housing member defining a switch cavity having an end wall and having a reset housing receiving aperture formed through the end wall, a stationary electrical contact mounted on the end wall, a second electrically conductive housing member generally configured as a lid attached to and electrically isolated from the first housing member, an electrically conductive, snap acting disc cantilever mounted in the switch cavity and electrically connected to the second housing member, a movable electrical contact mounted on a free distal end of the disc movable into and out of electrical engagement with the stationary electrical contact, a third generally annular housing member having a bore attached to the first housing member with the bore in alignment with the reset housing receiving aperture, the third housing member having a guideway received in the switch cavity, a slide member mounted in the guideway for rectilinear movement between a protracted position adjacent the stationary electrical contact and a retracted position away from the stationary electrical contact, a push button disposed in the bore of the third housing member and being movable toward and away from the switch cavity, the push button having a camming surface depending therefrom, the slide member having a follower surface projecting upwardly therefrom adapted to engage the cam member and a spring member urging the slide member toward the protracted position, the slide member when in the protracted position blocking movement of the movable electrical contact as the movable electrical contact moves from a contacts disengaged position toward contact engagement.

4. A manual reset circuit protector according to claim 3 further comprising a heater mounted on the second housing member and the snap acting disc in turn mounted on the heater.

5. A manual reset circuit protector according to claim 3 in which the spring member is generally U-shaped having first and second legs joined together at a bight, one leg reacting against the third housing member in the bore thereof and the other leg being operatively connected to the slide member.

6. A manual reset circuit protector according to claim 3 in which the slide member is generally aligned with the snap acting disc.

7. A manual reset circuit protector according to claim 3 in which the stationary contact has a sidewall portion and an extension of the rectilinear movement of the slide member intersects the sidewall portion of the stationary contact whereby engagement of the slide member with mating surfaces of the contacts is precluded.

8. A manual reset circuit protector according to claim 3 in which the spring member is generally W-shaped having a first and second legs fixedly attached to the slide member and having a third leg reacting against the third housing member, the first leg forming the follower surface.

9. A manual reset circuit protector according to claim 3 in which the push button is formed with a sleeve having a free distal end, a lip extends radially outwardly from the distal free end, the bore of the third housing member formed with a lip which interacts with the lip of the push button sleeve to limit outward movement of the push button.

10. A manual reset circuit protector according to claim 9 in which the lip of the push button has a tapered surface portion which allows one directional movement of the push button lip passed the lip of the third housing member so that the push button can be inserted into the bore of the third housing member.

* * * * *